United States Patent [19]

Lonati

[11] Patent Number: 4,471,636

[45] Date of Patent: Sep. 18, 1984

[54] NEEDLE SELECTION DEVICE IN A CIRCULAR KNITTING MACHINE, IN PARTICULAR A HOSE KNITTING MACHINE

[75] Inventor: Francesco Lonati, Brescia, Italy

[73] Assignee: Lonati S.p.A., Brescia, Italy

[21] Appl. No.: 335,963

[22] Filed: Dec. 30, 1981

[30] Foreign Application Priority Data

Jan. 9, 1981 [IT] Italy ..... 19075 A/81

[51] Int. Cl.[3] ..... D04B 15/78

[52] U.S. Cl. ..... 66/221; 66/222

[58] Field of Search ..... 66/25, 75.2, 219, 221, 66/222, 224

[56] References Cited

U.S. PATENT DOCUMENTS

| | | | |
|---|---|---|---|
| 3,972,207 | 8/1976 | Vinas | 66/222 X |
| 3,990,270 | 11/1976 | Paepke | 66/220 X |
| 3,998,073 | 12/1976 | Luth | 66/221 |
| 4,099,390 | 7/1978 | Vinas | 66/219 |
| 4,100,767 | 7/1978 | Schieber et al. | 66/75.2 |

FOREIGN PATENT DOCUMENTS

| | | | |
|---|---|---|---|
| 2711828 | 9/1978 | Fed. Rep. of Germany | 66/25 |
| 1563200 | 3/1969 | France | 66/219 |

*Primary Examiner*—Wm. Carter Reynolds

*Attorney, Agent, or Firm*—Guido Modiano; Albert Josif

[57] ABSTRACT

For needle selection in a circular knitting machine, a device is disclosed which comprises a plurality of superimposed selecting levers, individually pivoted to a common structure and selectively movable between a position where they do not interfere with the pattern jack butts and a position where they interfere therewith, to urge them toward the needle cylinder. The selective movement is accomplished by means of electromagnets, one for each selecting lever, which are energized in accordance with the machine knitting program and move intermediate, preferably rod-like, drive elements the axial displacement whereof results in a pivotal movement of the respective selecting levers between the cited positions. The engagement of the intermediate elements with the selecting levers is accomplished through geometrical coupling. A minimal force is sufficient for the actuation, so that the size of the electromagnets can be minimized, while a prompt response is ensured.

2 Claims, 7 Drawing Figures

NEEDLE SELECTION DEVICE IN A CIRCULAR KNITTING MACHINE, IN PARTICULAR A HOSE KNITTING MACHINE

BACKGROUND OF THE INVENTION

This invention relates to a needle selection device in a circular knitting machine, in particular a hose knitting machine. More specifically, the invention relates to a selection device of the type which comprises a plurality of superimposed selecting levers, which are individually pivoted to a common structure and selectively movable between a position whereat one end thereof is located level with pattern jack butts to interfere therewith and urge the respective pattern jacks into an inoperative or rest position, and a position whereat said end is located at an intermediate level between the jack butts such as not to interfere therewith, the selective movement of the levers being accomplished through program controlled actuator means.

A device of this type is known from French Pat. No. 2,219,264. In this device, the actuator means for the selective movement of the selecting levers comprise electromagnets, each associated with a respective selecting lever at the end of the latter remote from the end intended for interfering with the jack butts, the various electromagnets being selectively energized in accordance with the machine knitting program.

This known device, however, has the disadvantage of being unsuitable for use on small size machines, such as hose knitting machines, because the arrangement of the various electromagnets above the respective levers requires much space. If the dimensions of the electromagnets are reduced for space reasons, the power available would be insufficient to attract the levers, which attraction is to occur, among others, against the bias of return members to permit the levers to return to the rest position upon de-energization of the respective electromagnets.

To obviate this shortcoming, attempts have been made to reduce the attraction distance between each electromagnet and the respective selecting lever. That is, it has been proposed to mechanically displace the individual levers into a position very close to the pole pieces of the respective electromagnets, or even to contact them, and to energize the electromagnets after the levers have reached that position. In practice, the electromagnets have rather been assigned the task of holding levers which have been previously displaced mechanically.

However, that procedure involves the preliminary displacement of all the levers, even those which, in accordance with the knitting program, should not be moved out of their rest positions. These are thus returned to their rest positions because the respective electromagnets are no longer energized to hold them.

The preliminary mechanical displacement is achieved, for example, through pattern jack butts acting on a profile portion of the selecting levers, as disclosed in British Pat. No. 1,481,146 (corresponding to U.S. Pat. No. 3,998,073) and in British Pat. No. 1,445,038, in which latter the selecting levers actually comprise flexible foils secured at one end thereof. The profile portion is followed by a recessed portion, which allows the respective levers to be returned to the rest postion lacking attraction by the associated electromagnets. It will be appreciated, however, that in addition to the need for mechanically urging indifferently all of the butts prior to the selection proper and for providing other complementary means of preliminary displacement, it becomes necessary to widen the individual levers apart such as to produce a sufficient circumferential extension of the profile and recessed portions to allow for the required displacements of the levers during the short time period of passage of the butts. In other words, it is necessary to increase the mass of the levers, which again imposes higher power requirements on the electromagnets, even though they are only energized to hold the levers. Above all, however, a device of that type is not useful for high speed machines, where the time allowed for the various displacements would be not enough unless the circumferential bulk of the levers themselves were further increased.

In the cited British Pat. No. 1,445,038, a solution is also described wherein the individual levers or foils are preliminarily shifted by means of disk cams arranged respectively under the foils and set to rotate synchronously with the needle cylinder. However, the latter solution exhibits serious space problems, especially in height, resulting from the need for superimposing a disk cam and electromagnet for each selecting lever. Moreover, that solution is also unsatisfactory from the standpoint of the knitting operation rate, owing to the sudden release of those foils which are not intended to be held attracted, which release action involves vibrations of the foils themselves before they are brought to their rest positions, a behavior which is further aggravated by the foils being of a flexible nature. Thus, in the instance of high rate knitting, the time available would be insufficient to ensure damping of such vibratory movements.

SUMMARY OF THE INVENTION

A primary object of this invention is to eliminate the aforementioned known device deficiencies by providing a section device of the type mentioned in the preamble, which only entails a limited constructional effort, lends itself for high speed or rate knitting, allows the use of electromagnets of minimal size, and requires no special profile configuration of the selecting levers, nor any prior mechanical displacement action by pattern jack butts.

This object is achieved by a needle selection device in a circular knitting machine, in particular a hose knitting machine, of the general type mentioned in the preamble, by the fact that between said actuator means, in particular of the type comprising one electromagnet for each selecting lever, and the respective selecting levers, there are provided intermediate drive elements selectively actuated by said actuator means and mechanically cooperating with the respective selecting levers to displace the same between said two positions.

Thus, in a device as indicated, it is no longer the electromagnet which attracts, or holds attracted, any respective selecting lever against the bias of its respective return member, but rather the electromagnet moves an intermediate element, the displacement whereof results in the pivotal movement of the respective selecting lever from one position into the other, specifically from the rest position into the operative one. Advantageously, it is possible to accomplish a multiplication of the displacement movements such that the intermediate element only performs a small distance displacement to provide the desired amount of displacement of the related selecting lever. More specifically, a cooperation becomes feasible between geometrical surfaces respectively formed on the intermediate element and associated selecting lever, so that the displacement of the intermediate element occurs in a different direction from the displacement of the related selecting lever. Thus, the biasing action exerted on the selecting lever by the return member only partly affects the electromagnet, it being mostly absorbed by suitable linking means, such as a guide wherealong the intermediate element is caused to move. It will be appreciated that, by virtue of the above provisions, not only may the electromagnets be of minimal power and, accordingly, of minimal size, but it is also possible to locate the bank of electromagnets in the most favorable position, given that the electromagnets are no longer to act directly on the selecting levers.

BRIEF DESCRIPTION OF THE DRAWINGS

Further features and advantages of the invention will be more clearly understood from the following detailed description of a preferred, but not limitative, embodiment thereof, given herein by way of example only and illustrated in the accompanying drawings, where.

DESCRIPTION OF THE PREFERRED EMBODIMENTS

Figure 3:
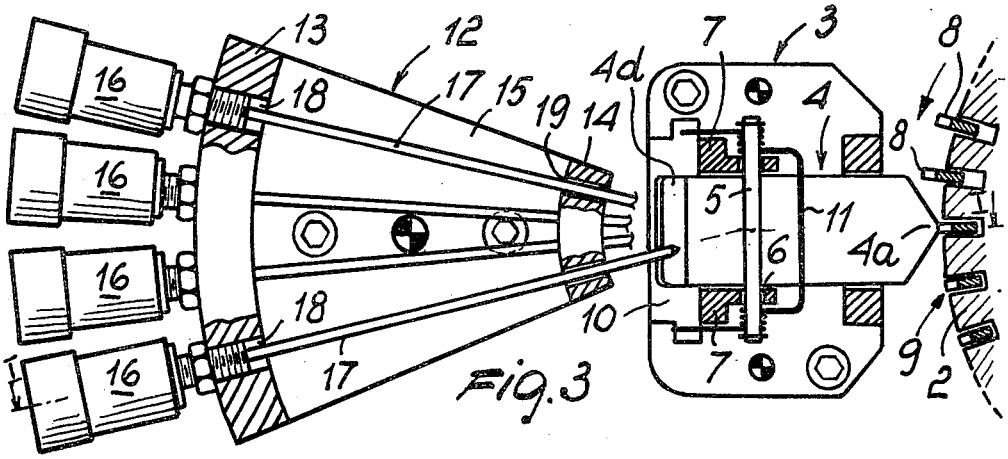
FIG. 3 is a partly sectional top plan view of the device shown in the preceding figures.

As may be noted in the drawings, on a stationary support surface or deck 1, which encompasses the needle cylinder 2 of a circular knitting machine all around, is arranged a housing structure 3 for accommodating a plurality of superimposed selecting levers 4 which extend in a substantially radial direction of the machine (FIG. 3). The levers 4 are pivoted individually, by means of related pivot pins 5, in holes 6 of two uprights 7 of the structure 3. The holes 6 are located spaced apart by a distance equal to that between the various levels of the pattern butts 8 provided on rockable pattern jacks 9 of conventional design. The levers 4, which have a flattened shape, have a smaller thickness than the clearance between the butts 8 of two adjacent levels.

The levers 4 are selectively movable between an operative position, whereat their active ends 4*a* are located level with the butts 8, and an inoperative or rest position, whereat those same ends are located at an intermediate level between the butts 8. At the former position, each end 4*a*, which has a corner edge converging toward the cylinder 2 in the direction of rotation thereof (or in both directions, as shown in FIG. 3), urges those butts 8 which are on the same level toward the cylinder 2 (FIG. 2, bottom, and FIG. 3), so that the respective jacks 9 will not bring the corresponding needles to knit. At the latter position, the end 4*a* interferes with no butts 8, thereby the respective jacks 9 still protrude out of the cylinder 2 (FIG. 1) and bring the respective needles to knit in a known manner.

The two positions of the levers 4 are defined by small crossbars 10, which are attached to the uprights 7 at spacings which correspond to those of the holes 6 and which define stops means for the lever 4, so that any two adjacent crossbars 10 are alternately engaged by a part of the end 4*b* of one lever 4, which end has a smaller thickness dimension than the clearance between each crossbar 10. Torsion springs 11, being coiled each around one of the pins 5, serve to hold the respective levers 4 in their rest positions, whereat the end parts 4*b* engage the lower faces of the crossbars 10, at a point directly above the respective levers. Each spring 11 bears onto the ends of one of the crossbars 10, on one side, and on the respective lever 4, on the other side, or alternatively, is configured with its two ends in contact with one crossbar 10 and the middle part of it in contact with the respective lever 4 (FIG. 3).

Alongside the supporting structure 3, there is secured a guiding and supporting body 12 having a substantially U-like cross-sectional configuration, with two wings or extensions 13 and 14 and a base 15. As viewed from above (FIG. 3), the two wings or extensions 13 and 14 are arcuately shaped, and the base 15 is in the form of a sector of an annulus. To the outermost wing 13, there are attached plural electromagnets 16, the number whereof is the same as the number of levers 4, there being associated with each electromagnet a drive or control element 17, preferably of rod-like configuration, which extends substantially in the same plane as a respective one of the levers 4 and in a direction generally corresponding to the radial direction of the respective lever 4 to converge toward it by penetrating a related hole 18 through the wing 13 (which hole is also utilized to provide support for the corresponding electromagnet 16) and related hole 19 through the innermost or inboard wing 14.

Figure 5:
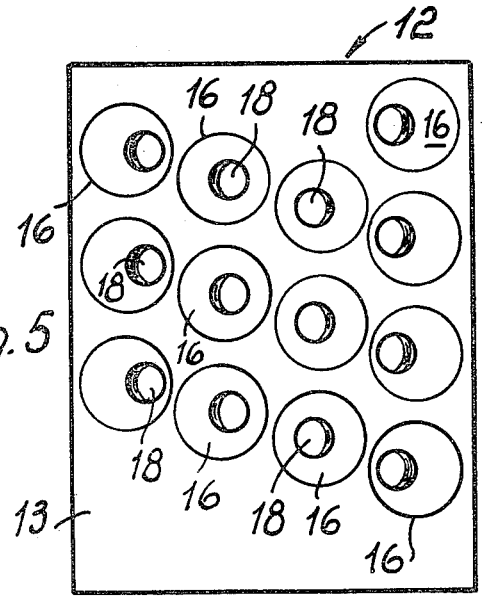
FIG. 5 is a detail view of the device as seen from the cylinder outside, the individual electromagnets being only shown schematically.

The substantially radial arrangement of the drive elements 17 and respective electromagnets 16, whereby they converge toward the selecting levers 4, is preferred for space reasons. It allows the electromagnets 16 to be arranged staggered at various levels and different columns, as shown in FIG. 5, so as to maintain a minimal spacing between the levels or tiers of levers 4 and butts 8.

According to the invention, the drive elements 17, which are configured as intermediate elements between the program operated actuator means, as defined by the electromagnets 16, and respective selecting levers 4, are directly actuated by the electromagnets 16 and cooperate mechanically with the respective selecting levers 4 in displacing them between the two positions described hereinabove.

According to a particularly advantageous embodiment of the invention, the end of each intermediate drive element 17 located on the same side as the respective lever 4 and the adjacent control end 4*b* of each lever 4 i.e. the end opposite to the active end 4*a* are given a geometrical profile defining a geometrical coupling such that the axial displacement of each drive element 17 entails a pivotal movement of the respective lever 4 between the rest position and the operative position thereof. More specifically, the two associated ends have sloping profiles, the end of the element 17 having a substantially conical shape and the end of the lever 4 having a flat inclined portion 4*c*, followed by a notch 4*d*. The inclination angles are substantially the same. Advantageously, the inclination angle over the horizontal is less than 45 degrees. The thickness of each selecting lever 4 at the notch 4*d* and the thickness of the associated end of the element 17 are such that, in combination, these dimensions equal the spacing between any two adjacent crossbars 10.

Figure 1:
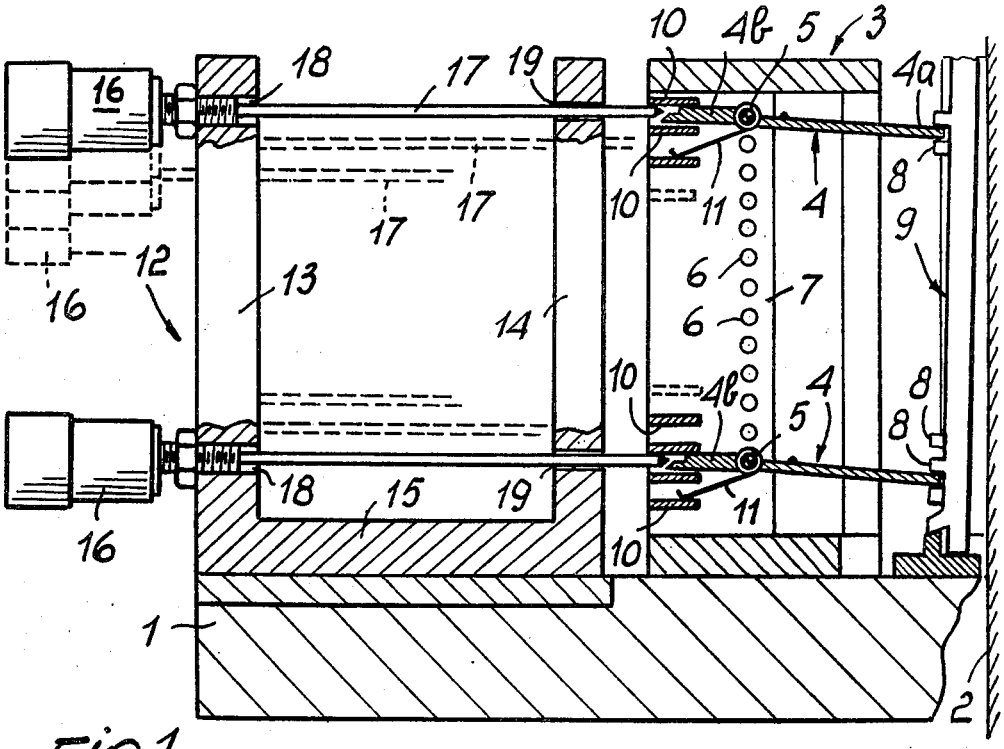
FIG. 1 is a fragmentary sectional view, taken along the line I—I of FIG. 3, of a selecting device according to the invention, showing two selecting levers in their rest positions and with the remaining levers omitted from view for simplicity of illustration.
Figure 2:
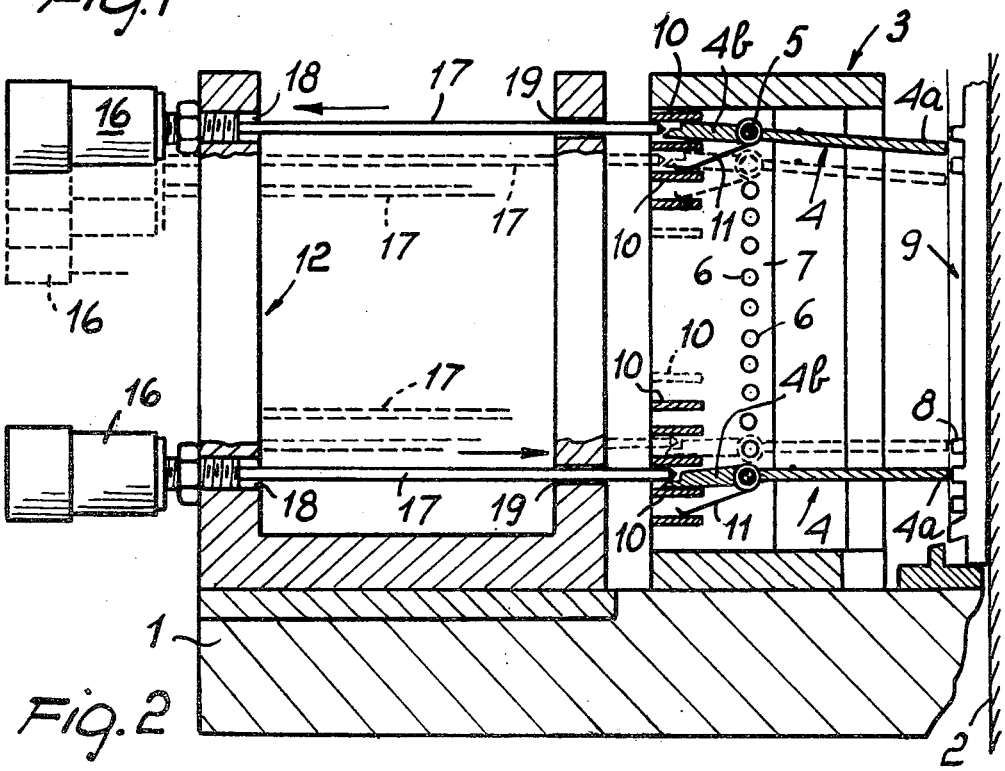
FIG. 2 is a fragmentary sectional view, taken similarly to FIG. 1, but showing the lower selecting lever in its operative position.
Figure 6:
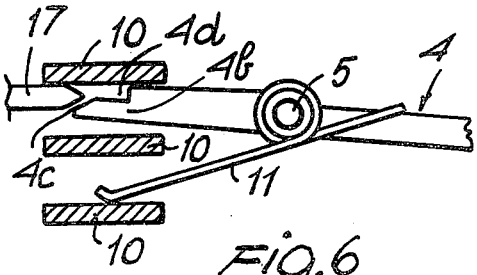
FIGS. 6 and 7 are enlarged views of the engagement area between one intermediate control or drive element and the respective selecting lever in the two different positions of the latter.
Figure 7:
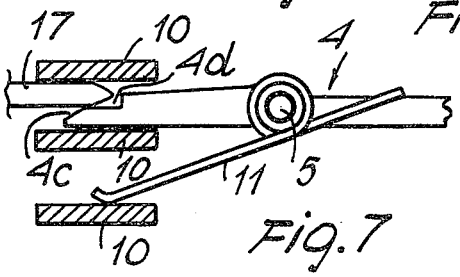

It will be apparent how the axial displacement of each drive element 17 from the rest position shown in FIG. 1 and FIG. 6, whereat the active end of the element is disengaged from the associated control end 4*b* of the respective selecting lever 4, into the operative position shown in the bottom portion of FIG. 2 and in FIG. 7, whereat the active end of the element 17 engages the associated end of the respective selecting lever 4, entails a very fast pivotal movement of the lever itself from the rest position into the operative position thereof. Moreover, the insertion of the active end of the element 17 between the notched end of the associated lever 4 and adjacent crossbar 10 stabilizes at once and definitely the operative position of the selecting lever involved. It would be noted that said inclination of the ends, or appropriate choice of the cooperating inclined surfaces, affords the possibility of reducing the effort on the element 17 and accordingly on the electromagnet 16, relatively to that, however minimal, required to displace the lever 4 and corresponding, neglecting frictional resistances, to the action of the torsion spring 11. It will be obvious that proper surface machining or an adequate lubrication of the same can make frictional resistances virtually insignificant. Minimal size electromagnets will, therefore, be quite adequate. Of course, this is also favored by that the efforts exerted on the levers 4 by the butts 8 in a radial (i.e. horizontal) direction are in all cases taken in by the pivot pins 5 and uprights 7. The selective energization of the electromagnets 16 thus enables a selective movement of the selecting levers 4 into the operative position in accordance with the machine program, whereas the de-energization of the electromagnets 16 results in the respective rod elements 17 being returned to the rest position because of the ceasing of the electromagnetic force thereon, and the respective levers 4 returning to their rest position under the action of the respective springs 11.

It will be appreciated that with the device described hereinabove there occur no vibrations of the various levers, the latter being readily locked into their operative position, whereas during the return travel thereof into the rest position, the torsion springs 11 act progressively on the lever 4, the disengagement of the active ends 17 from the associated ends of the respective levers 4 occurring progressively by virtue of the inclined surfaces provided.

Figure 4:
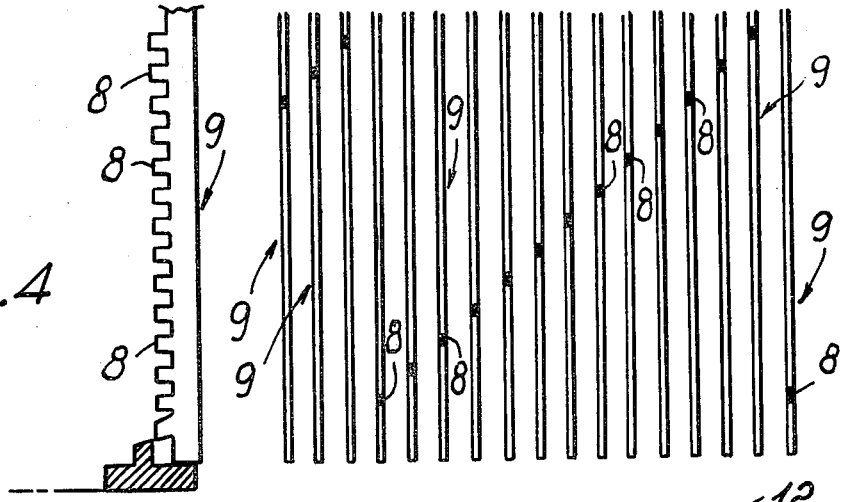
FIG. 4 is a fragmentary schematic representation of the butt arrangement on the adjacent pattern jacks, in a side view and front view with respect to the needle cylinder, respectively.

Thanks to the minimal displacement undergone by the drive elements 17 and to the instantaneous action on the respective selecting levers 4, the device of this invention also lends itself to use on high speed knitting machines, and the more so because the available actuation time is not conditioned by the provision of special lever profiles but only depends on the distance, made besides quite large, between consecutive butts 8 in one tier or on the same level (FIG. 4).

From an examination of the drawings, the simple construction of the device as a whole is also apparent, it only requiring, additionally to the articulated arrangement of the levers 4, the arrangement of linearly movable elements 17 and related electromagnets 16. The overall dimensions are also quite limited, and in all cases the device will mainly extend in a radial direction, namely the least critical machine direction.

The device as described in the foregoing is susceptible to many modifications and variations, without departing from the scope of the instant inventive concept. Thus, as an example, the intermediate drive elements 17 may be pneumatically operated instead of by means of electromagnets, or may be operated through traditional pattern drums, where circumstances are such that no special fast response requirements are imposed. Furthermore, return springs may be provided to return the drive elements 17 into their rest positions. Of course, the de-energization state of the electromagnets 16 may be made to correspond to the position of the levers 4 level with the butts 8, with the energization state of the electromagnets 16 arranged to correspond to the intermediate level between the butts 8. This device is obviously useful for application on single cylinder knitting machines, as well as double cylinder or cylinder and dial machines.

I claim:

1. A needle selecting device in a circular knitting machine, in particular a hose knitting machine, of the type having rockable pattern jacks and butts thereon, the device comprising a plurality of superimposed selecting levers extending in a substantially radial direction of the machine and individually pivoted to a common structure and selectively movable between a position in which one active end thereof is located level with said butts to interfere therewith and urge the respective pattern jacks into an inoperative position, and a position in which said one active end is located at a level intermediate between said butts such as not to interfere therewith, program operated actuator means for said selecting levers, and intermediate drive elements between said actuator means and said selecting levers, said intermediate drive elements being actuated by said actuator means and mechanically cooperating with respective of said selecting levers to displace said selecting levers between said positions, wherein said intermediate drive elements comprise rod-like elements extending in a direction generally corresponding to said substantially radial direction of said selecting levers, said selecting levers each having a control end opposite to said one active end and said rod-like elements each having one end cooperating with said control end of a respective of said selecting levers, said cooperating ends having sloping profiles such that an axial displacement of a corresponding of said rod-like elements causes a pivotal movement of a respective of said selecting levers between said positions.

2. A device as claimed in claim 1, further comprising a plurality of crossbars, superimposed on one another in spaced apart relationship and defining stop means for said selecting levers in said positions, wherein said control ends of said selecting levers each has an inclined portion and a continuous notch, said inclined portion defining one of said sloping profiles, said rod-like elements and said selecting levers having a thickness such that said thickness of said rod-like elements at said one end thereof cooperating with said inclined portion and said thickness of said selecting levers at said notch combined together substantially correspond to the spacing between said crossbars, whereby said selecting levers can be locked in either of said positions by said rod-like elements penetrating said notches.

* * * * *